United States Patent [19]

Wang et al.

[11] 4,371,194

[45] Feb. 1, 1983

[54] UNIVERSAL BINDING FOR MAKING VARIABLE SIZED BOOKS AND REPORTS

[75] Inventors: James C. Wang, Libertyville; Donald Murfitt, Glenview; Paul H. Livingston, Hoffman Estates; Luis K. Joson, Lincolnwood, all of Ill.

[73] Assignee: General Binding Corporation, Northbrook, Ill.

[21] Appl. No.: 162,507

[22] Filed: Jun. 24, 1980

[51] Int. Cl.[3] ..... B42D 3/00; B42C 9/00

[52] U.S. Cl. ..... 281/21 R; 281/29; 412/37

[58] Field of Search ..... 281/19 R, 19 A, 21 A, 281/23, 29, 34

[56] References Cited

U.S. PATENT DOCUMENTS

| | | | |
|---|---|---|---|
| 3,847,718 | 11/1974 | Watson | 281/21 R X |
| 3,933,375 | 1/1976 | Humphrey | 281/34 |
| 3,957,287 | 5/1976 | Hall | 281/29 |
| 3,973,787 | 8/1976 | Staats | 281/21 R |
| 4,129,471 | 12/1978 | Rome | 281/21 R X |
| 4,139,216 | 2/1979 | Saint Clair | 281/19 R X |
| 4,289,330 | 9/1981 | Wiermanski | 281/23 X |

FOREIGN PATENT DOCUMENTS

| | | | |
|---|---|---|---|
| 2821504 | 3/1979 | Fed. Rep. of Germany | 281/29 |

*Primary Examiner*—Paul A. Bell

*Assistant Examiner*—John S. Brown

*Attorney, Agent, or Firm*—Hill, Van Santen, Steadman, Chiara & Simpson

[57] ABSTRACT

A book cover structure of the type having front and back covers for binding sheets therebetween. A backbone area is joined with the front and back covers. The backbone area is provided with spaced parallel strips of hot melt adhesive with transversely extending bridge means of hot melt adhesive extending therebetween the width of the backbone area. Spaced score lines are positioned between the parallel strips under the bridges in parallel relation relative to the strips to enable the user to flex the binding along selectable score lines relative to the backbone area. The bridge means of hot melt adhesive and the strips comprise means for holding sheets in bound engagement with the backbone area. The bridge means of hot melt adhesive extend across the score lines and thus provide continuity of adhesive on opposite sides of and across the score lines. At least one of the covers may have a second set of spaced parallel score lines adjacent an outer edge remote from the backbone area and disposed in parallel relation relative to the strips. At least one of the score lines in the second set may be folded leaving the outer edge in lapped relation relative to the associated cover, the score lines in the second set being selectably usable depending on the number of the sheets to be bound.

19 Claims, 5 Drawing Figures

UNIVERSAL BINDING FOR MAKING VARIABLE SIZED BOOKS AND REPORTS

BACKGROUND OF THE INVENTION

Currently, fix-sized binders or cover structure are available for certain types of binding applications. There are about 14 sizes of binder that are available to cover the full range of sizes from 1/16" to 2". In the past, users of these types of heat sensitive binders have had to order binders of a variety of sizes to anticipate future needs. Since there have been so many sizes, considerable space has been required for storing them. Furthermore, if one's needs changes due to unexpected events, the user would be either short of covers of right sizes or in possession of binders of wrong sizes, or both. Problems of these types have been rather serious for casual users of binders of cover structures of the type here under consideration.

As those familiar with the stationery arts are aware, sheets of paper, or the like, have been bound together at one edge through the medium of resilient adhesive. A well known example of this technique is seen in the typical "pad" of paper in which the individual sheets are sequentially usable and removable from the pad by physical disengagement from the adhesive. In such binding systems, the sheets have been physically clamped to provide a maximum compression adjacent the edge to be supplied with adhesive. With the clamped sheets thus positioned, an adhesive material has been similarly applied to pamphlets, books, and the like, utilizing apparatus designed to first stack the sheets in aligned condition and then rigidly clamp the sheets adjacent the edge to be glued. Many books have been bound utilizing such prior art systems. However, for typical office or home use, the apparatus envisaged for such binding procedures has been extremely expensive and has required relatively skilled personnel for its successful operation. In the main, bookbinding done under such circumstances has required large manufacturing facilities and has been done on a high-volume basis only. At the same time, means have continually been sought permitting simple edge-binding. Although simplifications have been attempted in the formerly employed clamping systems, continued research led to the development of the bookbinding systems disclosed in U.S. Pat. No. 3,973,787, for use in an ordinary office and home operation. FIGS. 1–4, and FIGS. 12, 13 and 15 among others show the state of the art prior to the development of the present invention. With the bookbinding system shown in U.S. Pat. No. 3,973,787 hot melt adhesive strips of the new type disclosed in this application were not known or previously employed.

SUMMARY OF THE INVENTION

In accordance with the present invention, the cover structure or binder hereindisclosed can be used to bind books of a variety of sizes, instead of being limited to one size. The new improved book cover structure or binder structure here disclosed is comprised of paper stock with adhesive strips laid down at places specified and scored at place specified. In an illustrated embodiment, two types of adhesive strips are employed, one type being of a transversely ribbed or dotted construction and the other type being of a plain construction. These adhesive strips are laid onto the paper stock in parallel rows with the ribs providing bridge means touching the adjacent plain strips. Score lines are provided parallel to the strips in the ribbed area adjacent the plain strips. The ribbed or dotted strips provide a continuity of adhesive throughout the cover backbone area while allowing the cover to be bent at various places to provide a plurality of different effective backbone widths.

A thermally activatable adhesive is combined with a loosely gathered sheaf of sheets. The gathered sheets are jogged or otherwise aligned so that the edge thereof to be bound lies horizontally upon strips and/or rows of heat sensitive adhesive positioned on a backbone area where hot melt or heat sensitive adhesive strips provide means for securing the jogged sheets to the backbone area. The strips and/or rows of hot melt adhesive are heated to secure the sheets in assembly with the backbone. In accordance with important features of this invention, bridge means, for example ribbed or dotted heat sensitive adhesive strips, are disposed transversely to, and on opposite sides of, hot-melt adhesive strips for providing a backbone for a book cover structure with front and back covers being connected to the backbone along parallel scribes or scorelines positioned adjacent to the hot melt strips and with the ribs transversely crossing the scorelines. Stated another way, a very important feature of this invention concerns a book cover structure having a plurality of hot melt adhesive strips positioned in parallel relation with adhesive bridges therebetween for forming a backbone for a book cover of variable size depending upon the number (thickness) of gathered sheets to be secured to the backbone.

According to other features of this invention, we have provided a cover structure adapted to bind variable numbers of pages or sheets of a type where ribs or dots on the ribbed strips must definitely extend across the scoreline defining the juncture between the cover and the backbone for the purpose of providing a flexible crease or fold between the backbone and the cover.

In copending U.S. application for patent, (Ser. No. 162,608), transversely extending adhesive "ribs" or bridges were disclosed for preventing sheets from falling into bare gaps between adhesive strips at the edges of the book backbone before binding and at the initial period of binding. Later in the binding process, the heat melts the adhesive ribs so that the sheets on them can fall down to anchor themselves into adhesive for good binding.

As further described in that application, when a uniform adhesive layer is presented in the scored area, even though the layer is only 6 mils. thick, a bad fold typically results if a fold is attempted in the cold state. When the transverse ribs, or bridges, were made narrow enough at least at certain points in the scored area, and furthermore, if a generally straight score line can be drawn to go through most of these points, good folds can be made even if adhesive ribs are present in the scored area.

According to this invention, we have provided a new and improved book cover structure where at least one of the covers has a second set of spaced parallel score lines adjacent an outer edge remote from the backbone and disposed in parallel relation relative to the strip, at least one of the score lines in the second set being foldable leaving the outer edge for disposition in lapped relation relative to the associated cover, the score lines of the second set being alternatively usable depending on the number of the sheets to be bound.

Still other features of the invention concern the use of a second set of spaced parallel score lines adjacent an outer edge remote from the backbone and disposed in parallel relation relative to the strips and where the cover has its second set of score lines positioned outwardly beyond an outer edge of the other cover so that one cover is wider than the other.

Other objects and features of this invention will become more fully apparent in view of the following detailed description of the drawings illustrating a single embodiment and wherein.

DETAILED DESCRIPTION OF THE DRAWINGS

Figure 1:
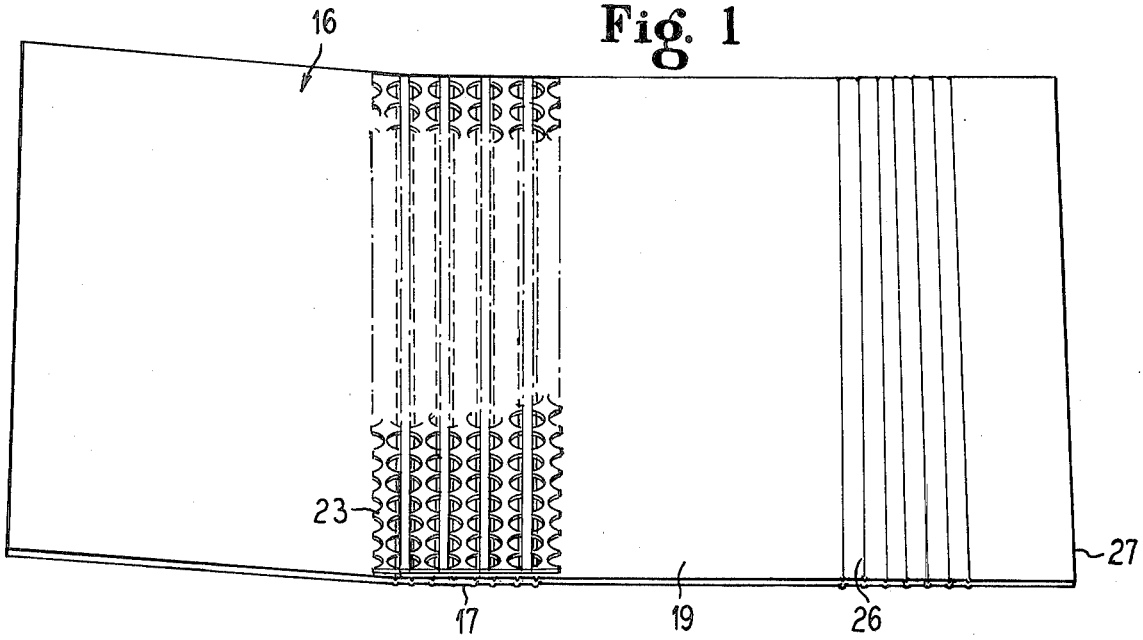
FIG. 1 is a perspective view of a book cover structure embodying important features of our invention.
Figure 2:
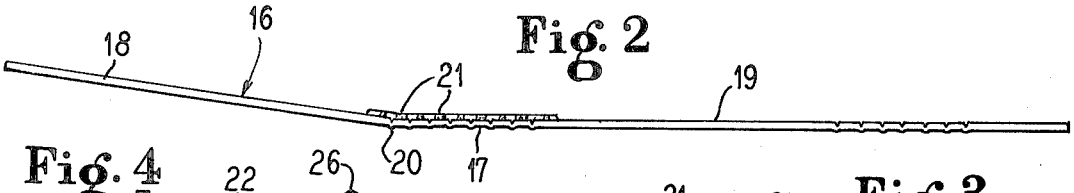
FIG. 2 is an edge elevation of the book cover structure shown in FIG. 1.
Figure 4:
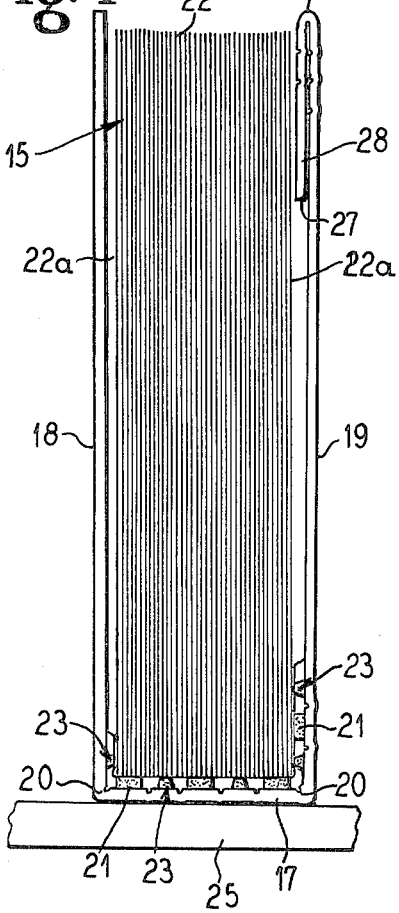
FIG. 4 is an enlarged end elevation of a book cover structure having sheets to be bound mounted therein and with the assembly mounted on a hot plate.
Figure 3:
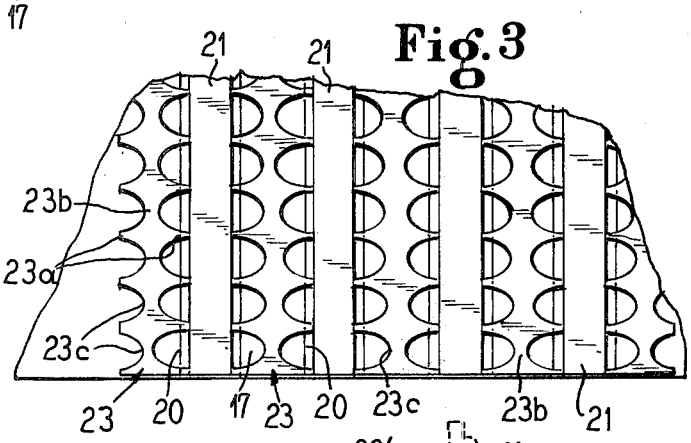
FIG. 3 is an enlarged fragmentary plan view of a backbone area of the book cover structure shown in FIGS. 1 and 2.

According to the present invention, an unbound universal binder or book cover structure 15 (FIG. 4) includes a book cover 16 having a backbone area 17 with a front cover 18 and back cover 19 secured in assembly therewith. Scribes or score lines 20 separate the front and back cover 18 and 19 from the backbone 17. Uniform, or straight strips of hot melt adhesive 21 are secured to the backbone area 17 in the same manner described in U.S. Pat. No. 3,973,787.

In the manufacture of the book cover 16, ribbed rows or strips 23 of hot melt adhesive are secured to the backbone area 17 contemporaneously with the securement of the backbone strips of adhesive 21 all as shown in FIGS. 1–4. When a consumer is desirous of binding sheets 22 with a book cover 16, sheets 22 are placed on top of the backbone of adhesive 21 in edgewise relation thereto. The strips 23 are comprised of a series of transversely extending ribs **23*a* connected to a common center connecting row portion 23*b*. The ribs 23*a* on a common side of row 23*b* are separated by rib grooves or valleys 23*c*. The row portion 23*b* serves to connect all of the associated ribs 23*a* in each row or strips 23 together. Each of the strips 21 and 23** preferably has a thickness of about 0.030 inches and excellent results can be also secured by varying the thickness to the extent of ±5 thousandths of an inch.

An examination of adhesive materials that are satisfactory for the present method shows that a number of so-called "hot-melt" adhesives having in the range of 20–40 percent of ethylene vinyl acetate of a medium to high viscosity in combination with about 20% tackifier, ordinarily a natural resin, with the balance of microcrystalline wax as a carrier with a melt point on the order of 150°–160° F. may be used. It is desirable that the melt temperature of the adhesive composite approximate 220° F., and that the adhesive be remeltable so that additional pages may be added later, if desired.

A typical cover may, as above noted, comprise a paper card, or similar stock. Preferably, the backbone 17 is then spread with strips of the thermally activated or hot melt adhesive. We have found that the application of such a cover, with its adhesive, to a heater at a temperature on the order of 325° F. for a relatively short period of time does not in any way adversely affect the cover or its contents.

The heater or plate 25 that is used to melt the adhesive strip 21 can be of any suitable type. As an example, the hot plate or heater 25 can be operated in the same way as the heater 25 described in U.S. Pat. No. 3,973,787.

In accordance with certain features of the manufacture of a universal binder 15, the cover 19 has a second set of spaced parallel score lines 26 adjacent an outer edge 27 remote from the backbone area 17. The score lines 26 are disposed in parallel relationship to the strips 21. At least one of these score lines 26 in the second set is folded leaving the outer edge 27 in underlapped relation relative to the associated cover 19. The score lines 26 in the second set are alternatively usable depending on the number of sheets 22 to be bound. First, where there are a greater number of sheets 22 to be bound, then the score line 26 that is to be folded can be chosen so that underlapped cover flap 28 is varied in sized so that the cover 19 can be matched to the size of the opposite cover 18. From consideration of FIG. 4 it will thus be seen that the cover 19 has its outer flap portion 28 disposed beyond an outer edge of the opposite cover 18 so as to enable the user of the cover structure 15 to be able to adjust the size of the cover 17 to fit the number of sheets to be bound. It will also be seen that in the preferred form, that where the backbone area 17 is sized and folded at the score lines 20—20 that certain of the endmost rows 23—23 can be so positioned between the covers 18 and 19 and the sheets 22 to act as inside spacers and guides. These spacers or guides or endmost rows 23 thus serve to assist in the binding operation so that when the hot plate 25 is activated the outside sheets **22*a*—22*a* can rest upon bottom strips 21—21 across the width of the backbone and also rest on the rows 23 and in this way the sheets can be supported while being bound. It will also be seen that at least some of the score lines 20 are arranged in pairs with each pair positioned inside of an associated pair of the spaced parallel strips, the associated ribbed row of hot melt adhesive being located between the score lines of the associated pairs of score lines. It will further be seen from a consideration of FIG. 3 that the ribbed rows 23 of hot melt adhesive comprise a chain of ribs 23*a* extending across the associated score lines 20—20 in proximity to the associated hot melt strips 21—21. Accordingly, all of the sheets to be bound will contact adhesive for adherence to the backbone area at least via the ribs or dots 23*a*. By the spacing of the ribs or the dots along the associated score lines 20, a sufficient adhesive can be provided at the score line while at the same time permitting the covers 18 and 19 to be easily folded relative to the backbone area by the binding operation. To facilitate the placement of the ribs 23*a* upon the backbone area 17 and upon the cover structure 15, the rows or strips 23 have the common center row area 23*b* acting as a chain to link the ribs and to permit the ribs 23*a*—23*a* to project in opposite direction away from the common center row area. As noted above, the ribs 23*a* are of sufficient length to intersect and cross-over the associated score line 20—20** to enable the cover to be flexibly folded relative to the score lines after heating of the hot melt adhesive as previously described.

The distance between the tip ends of the ribs can be of the order of 5/64". Also, the depth of the groove **23*c* between the ribs 23*a*** can be 5/64". While these relationships can be varied, it will be appreciated that excellent results can be attained when the spacings are made in accordance with the dimensions just described.

Figure 5:
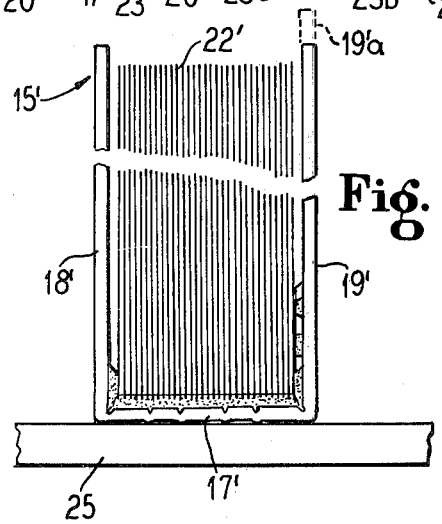
FIG. 5 is an end elevation of a modified type of bound book cover structure on a hot plate.

In FIG. 5 a modified bound cover structure 15' is shown having a backbone 17' and covers 18' and 19' integral therewith. As can be seen, this cover structure 15 is provided with sheets 21' that are adapted to be adhered to the cover structure through the use of the hot plate 25 in the same way as previously described. With respect to this form of the invention, the cover 19' is made having a dimension of width which exceeds the other cover 18' with the added length being shown at 19a'. Once the sheets 22' have been bound to the backbone 17', the outer edge or length 19a' can be trimmed by a scissors so that the width of the covers 18' and 19' can be made identical.

In view of the foregoing, it will now be seen that the universal binder can be provided to accommodate varying numbers and/or smaller numbers of sheets 22 as needed. The bridge means, or ribs, 23a operate to cause every sheet to rest on adhesive during warm-up for binding. Further, the bridges aid in assuring that adhesive flows readily into the scored spaces during heating providing, after the book has cooled, a relatively uniform solid backbone in which all of the sheets are firmly embedded and attached. In this way, the user need not stock as many sizes of binders to satisfy his occasional needs.

As those skilled in the art will observe, variations may be made without departing from applicant's invention. For example, the cross-score-line bridges may include any of those mentioned in copending application (Ser. No. 162,608) filed on even date herewith. For example, the scored area may have a meander or serpentine of adhesive therein, or air foam, or a tunnel under the bridge means. Such structure provides the cover as above described and are clearly within the intent of the broad recitations of bridge means set forth in the specification and claims.

We claim as our invention:

1. A book cover structure of the type having front and back covers and sheets bound therebetween, the improvement of a backbone area joined with the front and back covers, the backbone area before binding initially having parallel strips of hot melt adhesive thereon and ribbed rows of hot melt adhesive with each ribbed row alternated with one of said strips of hot melt adhesive across the width of a backbone area, and spaced score lines located between said parallel strips and said ribbed rows in parallel relation relative to one another to enable the front and back covers to be flexed along selectable score lines relative to the backbone area, said ribbed rows of hot melt adhesive and said strips after being heated comprising means holding said sheets in bound engagement with said backbone area, said ribbed rows of hot melt adhesive initially extending across the score lines and thus providing adhesive over the associated score line, the covers being folded at a pair of said score lines relative to said backbone area.

2. The book cover structure of claim 1 further characterized by at least one of said covers having a second set of spaced parallel score lines adjacent an outer edge remote from said backbone area and disposed in parallel relation relative to said strips, at least one of the score lines in the second set being foldable leaving the outer edge in lapped relation relative to the associated cover, the score lines in the second set being alternatively usable depending on the number of sheets bound to the backbone area.

3. The book cover structure of claim 2 further characterized by the cover having said second set of score lines positioned outwardly beyond an outer edge of the other cover.

4. The book cover structure of claim 1 further characterized by the backbone area having more than two score lines thus enabling a backbone to be made of different widths depending upon the number of sheets to be bound.

5. The book cover structure of claim 1 further characterized by at least some of the score lines being arranged in paids with each pair positioned inside of an associated pair of said spaced parallel strips, the associated ribbed row of hot melt adhesive being located between the score lines in the associated pair of score lines, some of said strips remaining between the covers and the facing ones of said sheets acting as separators after binding.

6. The book cover structure of claim 1 further characterized by said ribbed rows of hot melt adhesive comprising a linked chain of ribs with the ribs extending across the associated score lines in proximity to the associated hot melt strips.

7. The book cover structure of claim 1 further characterized by at least some of said ribbed rows of hot melt adhesive each having a common center row area, and by further having the ribs projecting in opposite directions away from said common center row area, the ribs being of sufficient length to intersect and crossover the associated score line and to contact the adjacent strip.

8. A book cover structure of the type having front and back covers for binding sheets therebetween, the improvement of a backbone area joined with the front and back covers, the backbone area having parallel strips of hot melt adhesive thereon which are generally rigid in the cold state, score lines positioned between said parallel strips in parallel relation relative thereto to enable the front and back covers to flex along selectable score lines relative to the backbone area, and flexible bridge means of hot melt adhesive extending between adjacent strips of hot melt adhesive while overlying said score lines comprising means for holding sheets in bound engagement with said backbone area, the bridge means comprising transverse rows of hot melt adhesive ribs each having a thickness on the order of 0.015".

9. The book cover structure of claim 8 further characterized by at least one of said covers having a second set of spaced parallel score lines adjacent an outer edge remote from said backbone area and disposed in parallel relation relative to said strips, at least one of the score lines in the second set being foldable to leave the outer edge in lapped relation relative to the associated cover, the score lines in the second set being selectively used depending on the number of sheets to be bound.

10. The book cover structure of claim 9 further characterized by the cover having said second set of score lines positioned outwardly beyond an outer edge of the other cover.

11. The book cover structure of claim 9 further characterized by said front and back covers having different widths and with the score lines adjacent said outer edge on one of said covers providing means for adjusting the widths so as to be the same.

12. The book cover structure of claim 8 further characterized by the parallel strips of hot melt adhesive having a thickness on the order of 0.030".

13. The book cover structure of claim 8 further charaterized by the backbone area having more than two score lines thus enabling a backbone to be made of different widths to adapt to the number of sheets being bound.

14. The book cover structure set forth in claim 8 wherein the back cover is longer than the front cover for trimming the same length as the front cover during the binding of a book.

15. A book cover structure of the type having front and back covers for binding sheets therebetween, the improvement of a backbone area joined with the front and back covers, the backbone area having parallel strips of hot melt adhesive thereon which are generally rigid in the cold state, score lines positioned between said parallel strips in parallel relation relative thereto to enable the front and back covers to flex along selectable score lines relative to the backbone area, and flexible bridge means of hot melt adhesive extending between adjacent strips of hot melt adhesive while overlying said score lines and comprising means for holding sheets in bound engagement with said backbone area, at least some of the score lines being arranged in pairs with each pair positioned inside of an associated pair of said spaced parallel strips, the associated ribbed row of hot melt adhesive being located between the score lines of the associated pair of score lines.

16. A book cover structure of the type having front and back covers for binding sheets therebetween, the improvement of a backbone area joined with the front and back covers, the backbone area having parallel strips of hot melt adhesive thereon which are generally rigid in the cold state, score lines positioned between said parallel strips in parallel relation relative thereto to enable the front and back covers to flex along selectable score lines relative to the backbone area, and flexible bridge means of hot melt adhesive extending between adjacent strips of hot melt adhesive while overlying said score lines and comprising means for holding sheets in bound engagement with said backbone area, said rows of hot melt adhesive comprising a linked chain of ribs with the ribs extending across the associated score lines in proximity to the adjacent hot melt strips.

17. A variably sizable book cover structure of the type having front and back covers for binding sheets therebetween, the improvement of a backbone area joined with the front and back covers, the backbone area having parallel strips of hot melt adhesive thereon which are generally rigid in the cold state, score lines positioned between said parallel strips in parallel relation relative thereto to enable the front and back covers to flex along selectable score lines relative to the backbone area, and flexible bridge means of hot melt adhesive comprising spaced ribs extending between adjacent strips of hot melt adhesive while overlying said score lines and comprising means for holding sheets in bound engagement with said backbone area, the ribs having spaced adhesive-free areas therebetween reducing the volume of adhesive overlying the score lines and enhancing the flexibility of the covers along the score lines.

18. The book cover structure of claim 17 further characterized by the parallel strips of hot melt adhesive having a thickness on the order of 0.030".

19. The book cover structure set forth in claim 17 wherein the back cover is longer than the front cover for trimming the same length as the front cover during the binding of a book.

* * * * *